United States Patent [19]

Lund et al.

[11] 4,092,943

[45] June 6, 1978

[54] MARINE PROTECTION SYSTEM

[76] Inventors: Norman Lund; George R. Young, both of 6525 New Haven, Melbourne, Fla. 32901

[21] Appl. No.: 706,299

[22] Filed: Jul. 19, 1976

[51] Int. Cl.[2] ..... B63C 1/00; E02C 3/00

[52] U.S. Cl. ..... 114/222; 261/DIG. 42

[58] Field of Search ..... 114/222; 61/54; 43/125; 21/74 A; 210/63 Z, 192; 261/DIG. 42

[56] References Cited

U.S. PATENT DOCUMENTS

| | | | |
|---|---|---|---|
| 632,919 | 9/1899 | Farley | 114/222 |
| 3,570,256 | 3/1971 | Thompson | 114/222 |
| 3,775,314 | 11/1973 | Beitzel et al. | 261/DIG. 42 |

*Primary Examiner*—Trygve M. Blix
*Assistant Examiner*—D. W. Keen
*Attorney, Agent, or Firm*—Duckworth, Hobby, Allen & Pettis

[57] ABSTRACT

An underwater marine protection system for preventing or retarding marine growth on vessels, pilings and submerged structures, in which a boat slip, or the like, has a series of gas diffusers placed under water located to direct gas towards the bottom of a marine vessel. The gas diffusers are connected to an ozone source for directing ozone gas through the diffusers towards the bottom of a boat. Skirts or curtains are connected to the pilings in the boat slip to prevent the free flow of water into and out of the slip where the water has been treated. A special top extends across the slip and around a vessel therein to increase the effectiveness of the ozone. An alternate embodiment has the gas diffusers formed in the bottom of the boat or submarine structure.

2 Claims, 4 Drawing Figures

MARINE PROTECTION SYSTEM

BACKGROUND OF THE INVENTION

The present invention relates to a system for retarding and preventing marine growth on vessels, pilings, submerged structures, and the like, utilizing ozone gas for disinfecting the surrounding water and for directing the gas directly against surfaces being protected.

In the past, a great variety of systems have been provided for the protection of marine going vessels, pilings, and submerged structures from the adverse effects of marine growth on the submerged portion thereof, which marine growth, such as barnacles, and the like, requires great expense to remove. Various types of paints and materials have been used to slow down or prevent marine growth on the bottom of vessels which are maintained on a more or less continuous basis in the water. Other systems have included various types of ultra-sonic sound systems, as well as the setting up of electrical fields along the bottom of the vessel to prevent marine growth thereon. One prior art system suggests to use a flexible plastic sheet which is pulled under the vellel to form an envelope for the bottom of the vessel so that clorine can be dumped into the envelope to prevent marine growth while the vessel is in a boat slip for any extended period of time. The present system on the other hand provides a permanently installed system located in a boat slip to prevent both the boat, pilings, and the like from becoming encrusted with marine growth while the marine vessel is in the boat slip. This system can, of course, be mannered along various types of submerged marine structures other than boat slips.

SUMMARY OF THE INVENTION

A marine protection system is provided in which a submerged marine structure, such as a boat slip, has a plurality of gas diffusers located below the surface of the water for feeding and dispersing gas into the water. An ozone generator is attached to the gas diffusers for directing and diffusing ozone gas into the water adjacent the marine structure. A series of skirts or curtains are mounted adjacent to the marine structure to prevent the free flow of water thereabout, so as to maintain the disinfected water in the area of the submerged structure over a longer period of time. A special top cover can direct the ozone gas and make it more efficient in the protection of the bottom of marine vessels.

BRIEF DESCRIPTION OF THE DRAWINGS

Other objects, features and advantages of the present invention will be apparent from the written description and drawings in which.

DESCRIPTION OF THE PREFERRED EMBODIMENTS

Figure 1:
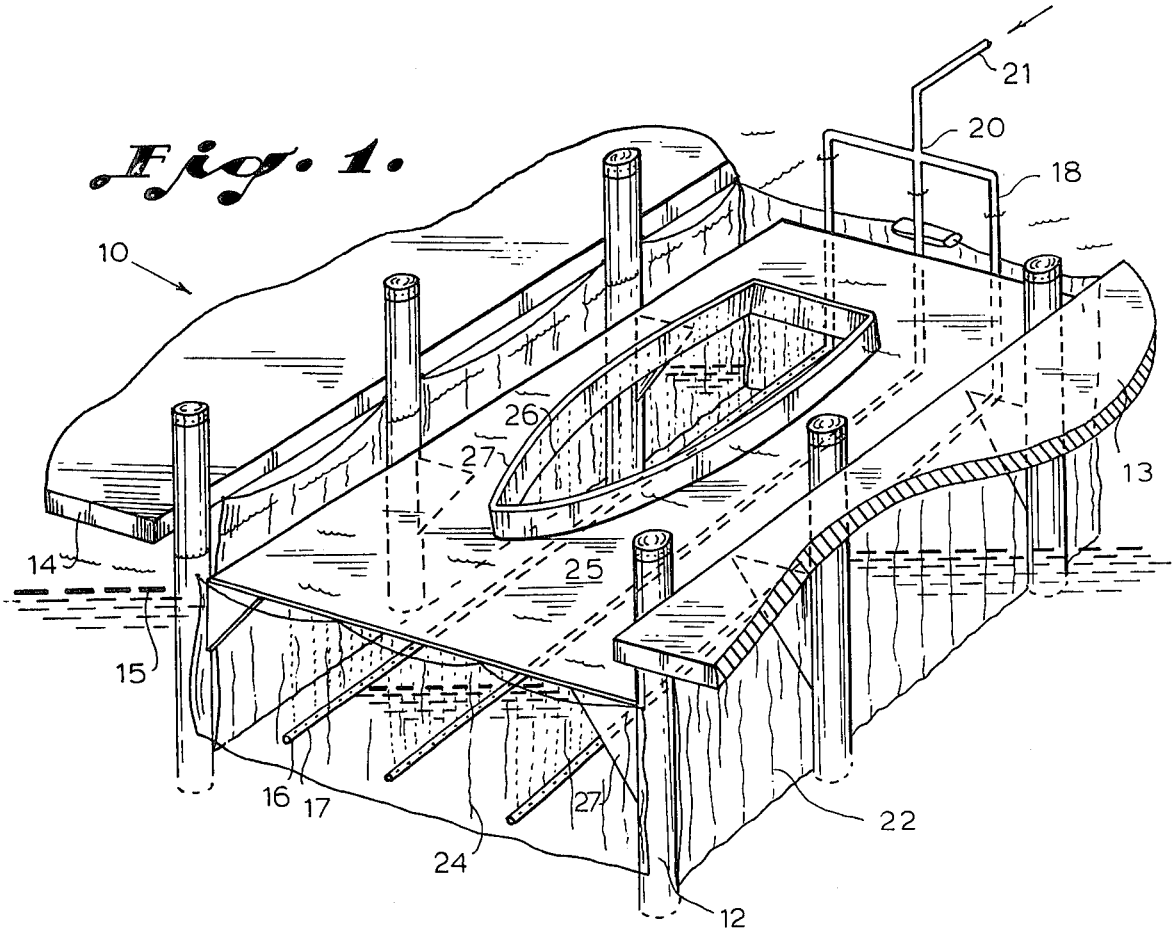
FIG. 1 is a perspective view of a boat slip having a marine protection system in accordance with the present invention installed thereon.
Figure 2:
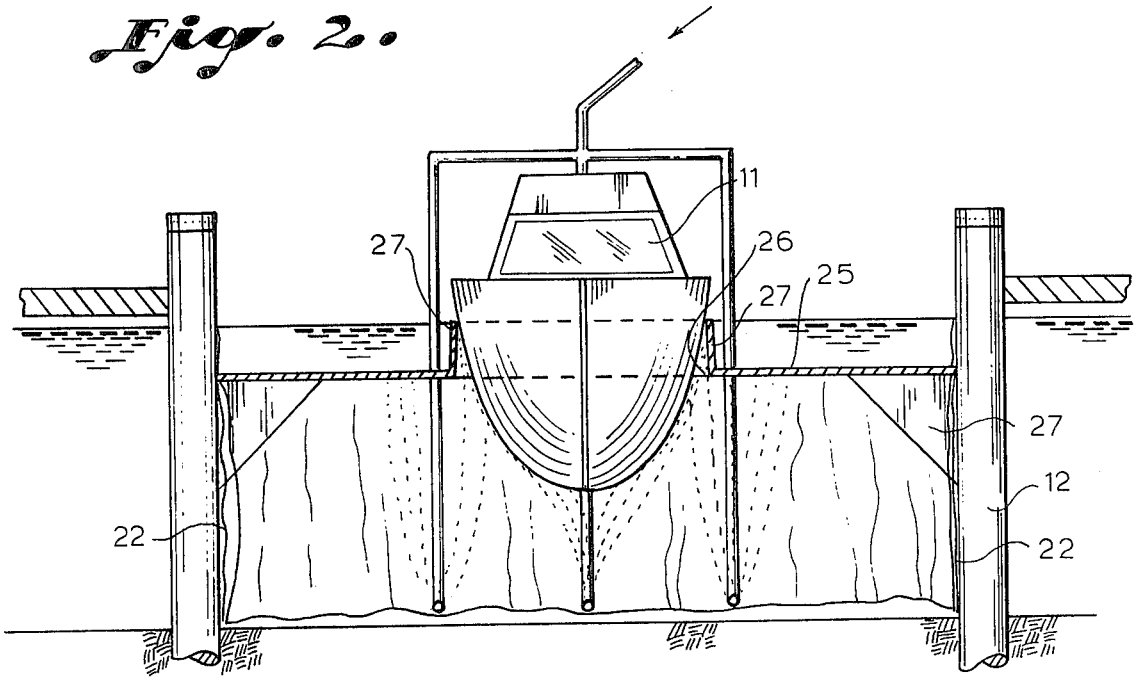
FIG. 2 is a front sectional view of the boat slip of FIG. 1 having a marine vessel therein.

A system for the retardation of marine life on ocean going and marine vessels and on submerged ocean going structures such as slips, wharfs, and moorings uses an ozone gas introduced into the water by diffusers, such as perforated tubes and may be directed or controlled with various skirts or curtains attached to the structures. Referring to FIGS. 1 and 2 of the drawings, a boat slip 10 is illustrated for mooring a boat 11 (FIG. 2) having a plurality of pilings 12 and platforms 13 and 14 attached thereto. This forms a typical boat slip for holding a boat by attaching the boat to the pilings 12. However, the pilings are under the water 15, usually for most of their length and the boat is maintained in the water so that marine growth continues while the boat is moored in the slip. The present invention has a plurality of gas diffusers 16 which may be plastic or other corrosion resistant pipes or tubes having perforations 17 therein. The diffusers 16 are located in the water 15 below the boat slip 10 so as to locate them directly beneath the normal positioning of the vessel 11. Diffusers 16 are coupled to pipes 18 that extend out of the water and are interconnected by the joint 20 to a single pipe 21. The pipe 21 leads to a gas generating and pumping system which would typically include an ozone generator which may for instance be of the type disclosed in prior U.S. Pat. No. 3,739,440 to Lund and may have a standard commercial gas pump for driving the ozone through the pipe 21 and through the pipe 18 into the gas diffusers 16 for evenly distributing the gas in small bubbles over a large area directly beneath the vessel 11. The ozone will disinfect the water in the vicinity of a boat slip, as well as reduce odors in the immediate area. This purification in the water increases the efficiency of the present system which includes a plurality of skirts, curtains or walls 22 attached to the pilings 12 by any conventional means, such as attaching hooks 23 which may hook into grommets in the curtains 22 for locking the curtains in place but allowing their easy removal and replacement. Other attachments can also be utilized without departing from the spirit and scope of the invention. These side curtains prevent the flow of water by tides and waves to maintain the purified water around the boat slip for a longer period of time. A front curtain 24 which may also be attached with hooks and grommets prevents the flow of water into and out of the boat slip from the front. The curtains do not prevent the exchange of water in the slip but merely stagnate the water to a degree to allow the purified water to be maintained around the boats and pilings.

The efficiency of the treating system is increased by a top portion or cover 25 having an opening 26 in the middle thereof for extending around the vessel 11 moored therein and which is attached to the pilings 12, either with the fixed brackets 27 which may be screwed or nailed to the pilings 12, or by a sliding bracket adapted to rise and fall with the rise and fall of the tide. The cover 25 may be rigid or flexible as desired and may have raised walls 27 surrounding the opening 26 to further direct the ozone from the diffusers 16 along the edge of the boat and to concentrate the purified water there-around. This allows the ozone to be utilized at intermittent intervals for continuously retarding marine growth in the boat slip. Typically, the curtains 22 and 24, top portion 25, and walls 27 can be made in various types of polymers or plastics either flexible or rigid and in the case of walls 27 can be foamed polymer which may also provide flotation if desired. Thus, in operation the ozone generator and gas pump would be connected to a timer to direct a percentage of ozone mixed with air, or the like, through the pipe 21 and 18 and into the diffusers 16 for directing small bubbles of gas underneath the vessel 11 which gas is captured by the top surface 25 and directed along the bottom of the boat and along the walls 27 while skirts 22 and 24 prevent the free-flow of water directing the gas away from the vessel and also maintaining the water in the slip in a relatively purified condition.

In a typical example, a forty-foot boat might typically be maintained in a slip having surrounding water of approximately 32,000 gallons and ozone might be fed thereto with a timer set for three hours treatment in each twenty-four hours feeding ozone at 0.5 parts per million.

Figure 3:
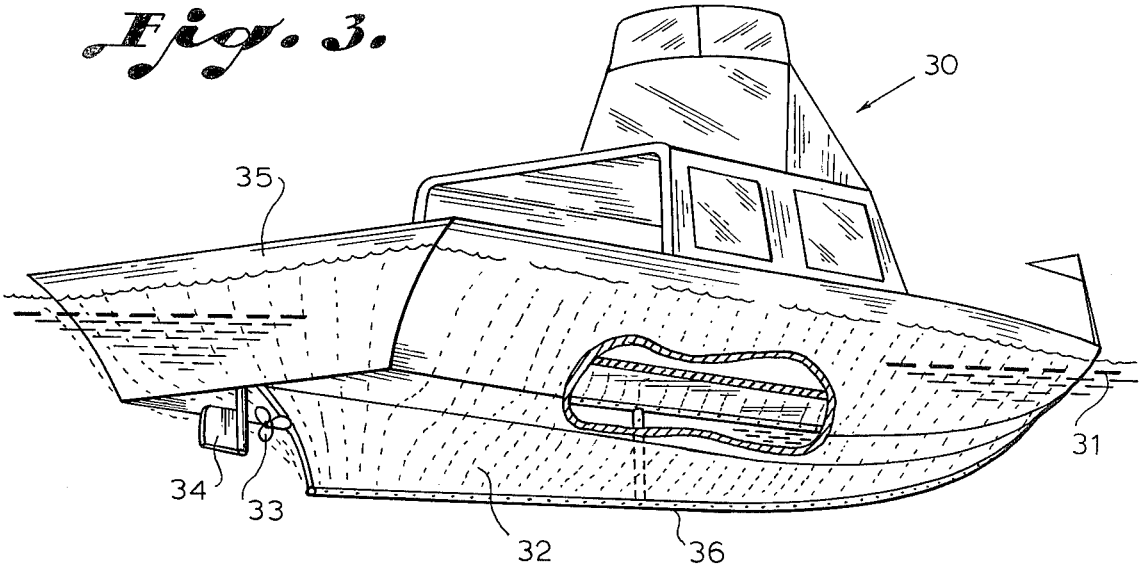
FIG. 3 is a cutaway perspective view of a marine vessel having a marine protection system in accordance with the present invention attached thereto.
Figure 4:
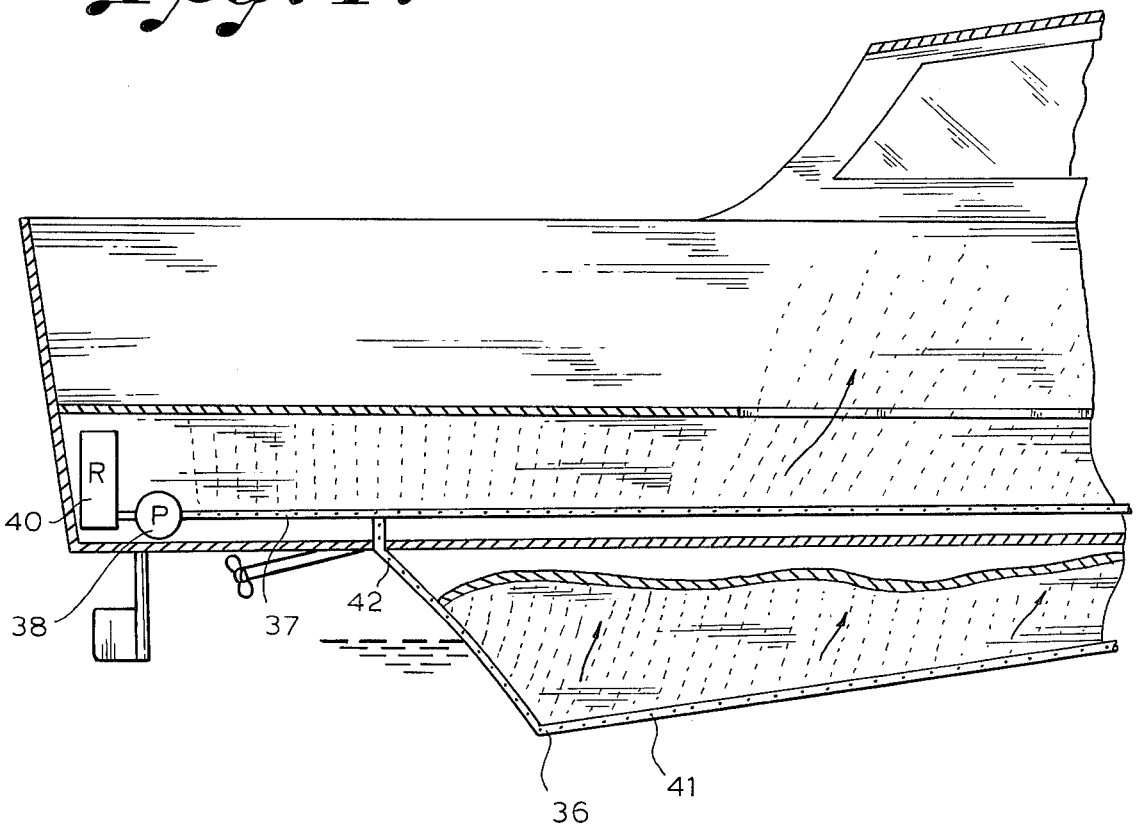
FIG. 4 is a sectional view of the side rear portion of the vessel of FIG. 3.

Turning now to FIGS. 3 and 4, an alternate embodiment of the present invention is illustrated attached to a boat 30 located in water 31 and having a center keel 32 with a prop 33 and rudders 34 located under the transom 35. The keel has formed therein a gas diffusion tube 36 which is connected through a tube 37 to a gas pump 38 which in turn is connected to an ozone generator 40 located in the boat. The ozone generator generates the ozone gas from the surrounding air which is pumped by the pump 38 through the pipe 37 along the diffusion tube 36 having a plurality of small openings 41 therein. The tubes 41 allow small bubbles of gas to be dispersed in the water under the keel and to rise up over the edges of the boat thereby assisting in retarding the marine growth on the bottom sides of the boat. A check valve 42 is located just in the boat to prevent the entry of sea water through the diffusion tube 36 into the interior of the boat where it could enter the pump 38. Valve 32 is a standard commercial valve that allows gas to pass towards the diffusion tube 36 but when the pump 38 is shut off, prevents the water from entering the tube 37. It will, of course, be clear that while a single gas diffusion tube 36 might be satisfactory for some boats other boats will require more than one or several tubes appropriately placed to give full coverage to the bottom of the boat. The tubes can be formed directly into the keel when the boat is built or in appropriate cases the tube can be added at a later time by simply molding the tubes to the keel. This diffusion tube may have two rows of opernings 41 to allow gas to escape to either side of the boat. This system can be utilized while at sea or at distant locations without departing from the spirit and scope of the invention. Accordingly, the present invention is not to be construed as limited to the particular forms shown herein which are to be regarded as illustrative rather than restrictive.

We claim:

1. A marine growth retardation system comprising in combination:

a marine structure located at least partially in water and having pilings to form a boat slip for housing a boat therein;

gas diffuser means located adjacent said marine structure below the water level for feeding and dispersing gas fed thereto, said gas diffuser means being mounted to the sea bed in said boat slip directly beneath the mooring position of a boat;

ozone generator means coupled to said gas diffuser means for directing ozone therethrough and to the surrounding water;

skirt means set vertically in the water adjacent said marine structure to restrict the flow of water therepast, said skirt means having a plurality of skirts removably attached to the pilings for said boat slip whereby ozone treated water adjacent said skirt means will prevent marine growth from fouling marine structures; and a removable cover adapted to fit over said boat slip and having an opening therein for a boat to fit thereinto in said boat slip, said opening in said top cover having a raised wall extending therearound for directing ozone gas passing therethrough.

2. A system in accordance with claim 1 in which said removable cover over said boat slip is held submerged and is removably attached to the pilings of said boat slip.

* * * * *